US006374740B1

(12) United States Patent
Moulard

(10) Patent No.: US 6,374,740 B1
(45) Date of Patent: Apr. 23, 2002

(54) TWO-STAGE OPTICAL DETONATOR WITH SHOCK-DETONATION TRANSITION

(75) Inventor: Henry Moulard, Saint Louis la Chaussee (FR)

(73) Assignee: Institut Franco-Allemand de Recherches de Saint-Louis (FR)

( * ) Notice: Subject to any disclaimer, the term of this patent is extended or adjusted under 35 U.S.C. 154(b) by 0 days.

(21) Appl. No.: 09/611,022

(22) Filed: Jul. 6, 2000

(30) Foreign Application Priority Data

Jul. 6, 1999 (FR) ..... 99 08715

(51) Int. Cl.[7] ..... F42B 3/08
(52) U.S. Cl. ..... 102/275.3; 102/201
(58) Field of Search ..... 102/275.3, 275.5, 102/275.7, 201

(56) References Cited

U.S. PATENT DOCUMENTS 3,238,873 A * 3/1966 Allen ..... 102/275.3
3,320,884 A * 5/1967 Kowalick et al. ..... 102/275.3

* cited by examiner

*Primary Examiner*—Michael J. Carone
*Assistant Examiner*—Lulit Semunegus
(74) *Attorney, Agent, or Firm*—Bachman & LaPointe, P.C.

(57) ABSTRACT

A first stage of a shock-detonation transition type two-stage optical detonator contains a pyrotechnic substance and an optical fiber, one end of which is connected to a source of laser radiation. The first stage pyrotechnic substance is separated from a pyrotechnic substance of the second stage by a metal plate, one face of which is in contact with the first stage pyrotechnic substance and whose other face is adjacent a cavity which separates it from the second stage pyrotechnic substance and whose edge portion bears against the end of a confinement member confining the second stage pyrotechnic substance.

11 Claims, 1 Drawing Sheet

TWO-STAGE OPTICAL DETONATOR WITH SHOCK-DETONATION TRANSITION

BACKGROUND OF THE INVENTION

1. Field of the Invention

The present invention relates to a shock-detonation transition type two-stage optical detonator.

2. Description of the Prior Art

A two-stage detonator is currently used to provide an optical detonator with low-power laser sources such as laser diodes for space applications: the first stage is used for thermal ignition of combustion by the laser and the second stage is dedicated to a blast-detonation transition.

A metal membrane at the interface between the two stages is cut by the combustion pressure in the first stage to form a plate which acts as a piston and compacts the porous explosive of the second stage and initiates combustion which, because of the confinement, initiates a blast-detonation transition process.

The disadvantages of this concept are associated with the use of the blast-detonation transition process. This necessitates:

- the use of a low charge density (1.1 g/cm3) explosive, in fact one with a density close to the density of compacting to have a high porosity and also large particle size: this increases the sensitivity of the pyrotechnic component and is not favorable to good reproducibility of charging in its small components, and
- a sufficient length of the second stage to reach the detonation transition point: in practice this significantly increases the quantity of explosive used.

The object of the present invention is to remedy the above disadvantages.

SUMMARY OF THE INVENTION

The invention therefore provides a shock-detonation transition type two-stage optical detonator wherein a first stage contains a pyrotechnic substance and an optical fiber one end of which is connected to a source of laser radiation and the other end of which is adjacent the pyrotechnic substance and is inserted into a connector and means between the end of the optical fiber and the pyrotechnic substance to transmit laser radiation towards the pyrotechnic substance and wherein a second stage contains a pyrotechnic substance aligned with the pyrotechnic substance of the first stage and separated therefrom by means for transmitting a shock wave generated by igniting the pyrotechnic substance of the first stage and the means separating the pyrotechnic substance of the first stage from that of the second stage comprise a metal plate one face of which is in contact with the pyrotechnic substance of the first stage and whose other face is adjacent a cavity which separates it from the pyrotechnic substance of the second stage and whose edge portion bears against the end of a confinement member confining the pyrotechnic substance of the second stage.

Because of the live combustion pressure generated on igniting combustion of the first stage pyrotechnic substance, the above metal plate is propelled at high speed onto the bare surface of the pyrotechnic substance of the second stage.

On impact, the plate triggers a shock-detonation transition in the pyrotechnic substance.

That shock-detonation transition is encouraged by focusing the shock wave.

The shock-detonation transition enables the manufacture of a shorter detonator which contains less pyrotechnic substance, which is less sensitive and more reproducible and which has a shorter response time than the solution referred to at the beginning of this description.

The diameter of the cavity is preferably greater than that of the second stage pyrotechnic substance and an end face of the second stage pyrotechnic substance adjacent the cavity is preferably coincident with the face constituting the end wall of the cavity.

Thus on impact the plate collides simultaneously with the pyrotechnic substance and with the end face of the cavity. This focuses the shock wave onto the pyrotechnic substance.

Other features and advantages of the invention will become more apparent in the course of the following description, which is given with reference to the accompanying drawing, which is provided by way of non-limiting example only.

DETAILED DESCRIPTION OF THE PREFERRED EMBODIMENTS

Figure 1:
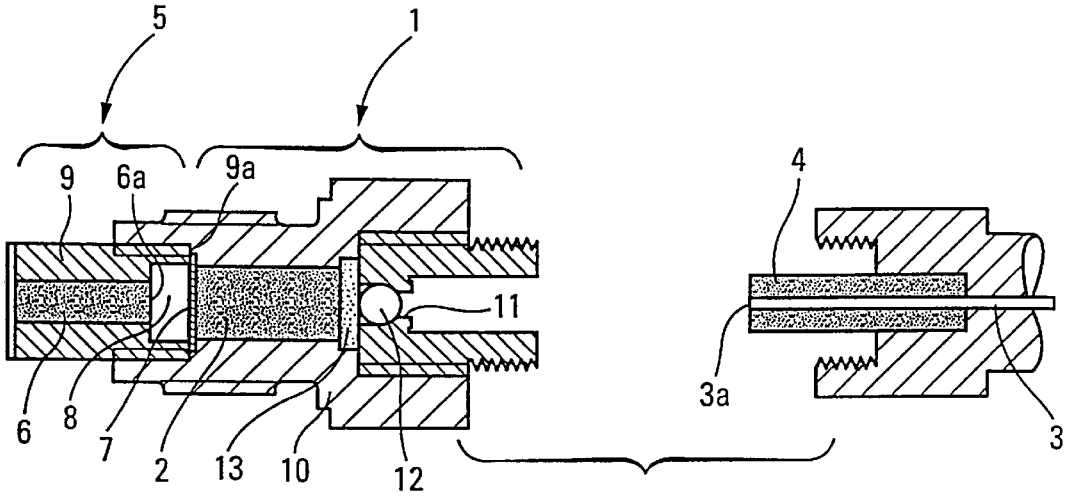
FIG. 1 is a view in longitudinal section of a two-stage optical detonator according to the invention.

FIG. 1 shows a shock-detonation transition type two-stage optical detonator in which a first stage 1 contains a pyrotechnic substance 2 and an optical fiber 3 one end of which is connected to a source of laser radiation such as a laser diode.

The other end of the optical fiber 3 adjacent the pyrotechnic substance 2 is inserted into a connector 4.

Means described below are inserted between the end 3*a* of the optical fiber 3 and the pyrotechnic substance 2 to transmit the laser radiation to the pyrotechnic substance 2.

A second stage 5 of the detonator contains a pyrotechnic substance 6 aligned with the pyrotechnic substance 2 of the first stage 1 and separated therefrom by means for transmitting the shock wave generated by the ignition of the pyrotechnic substance 2 of the first stage 1.

In accordance with the invention, the means which separate the pyrotechnic substance 2 of the first stage 1 from that of the second stage 5 comprise a metal plate 7 one face of which is in contact with the pyrotechnic substance 2 of the first stage 1 and the other face of which is adjacent a cavity 8 which separates it from the pyrotechnic substance 6 of the second stage 5.

The edge of the metal plate 7 bears on the end 9*a* of a confinement member 9 for confining the pyrotechnic substance 6 of the second stage 5.

The pyrotechnic substance 2 of the first stage 1 is confined in a confinement member 10 which is joined axially and removably to the confinement member 9 of the pyrotechnic substance 6 of the second stage 5.

In this example, the two confinement members 9, 10 are screwed together.

FIG. 1 also shows that the end face 6*a* of the pyrotechnic substance 6 adjacent the cavity 8 is coincident with the face constituting the end wall of the cavity 8 whose diameter is greater than that of the pyrotechnic substance 6.

The plate 7 can be made of steel, for example, with a thickness from 100 micrometers to 250 micrometers.

The laser energy transmitted to the pyrotechnic substance 2 of the first stage 1 and the characteristics of that substance are preferably such that the plate 7 can be propelled into the cavity 8 at a speed of not less than 500 m/s by the pressure developed by igniting the pyrotechnic substance 2.

The pyrotechnic substance 2 preferably includes octogene having a charge density of the order of 1.65 g/cm$^3$ and a particle size of the order of 3 micrometers.

The octogene can be mixed with approximately 1% ultrafine carbon black to favor absorption in the near infrared.

The pyrotechnic substance 6 of the second stage 5 preferably includes octogene or hexogene in granular form and having a density greater than 1.4 g/cm$^3$.

FIG. 1 also shows that the means for transmitting the laser radiation from the optical fiber 3 to the pyrotechnic substance 2 of the first stage 1 comprise a ring 11 with a glass ball 12 housed in its aperture.

The ring 11 is in contact with the end of the connector 4 of the optical fiber 3 and with a glass plate 13 which is itself in contact with the pyrotechnic substance 2 of the first stage 1.

This arrangement enables transmission of the laser radiation to the pyrotechnic substance 2 with no surface energy loss.

Figure 2:
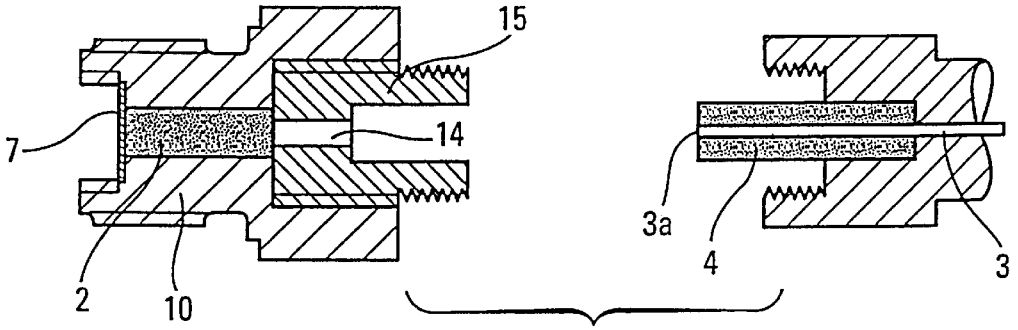
FIG. 2 is a partial view in longitudinal section of a different embodiment of the invention.

In the embodiment shown in FIG. 2 the means for transmitting the laser radiation between the optical fiber 3 and the pyrotechnic substance 2 of the first stage 1 comprise a graded index glass rod 14 housed in a member 15 made from a material that is a poor conductor of heat. The glass rod 14 is capable of focusing the laser radiation from the optical fiber 3 onto the face of the pyrotechnic substance 2 of the first stage 1 with which the glass rod 14 is in contact. The glass rod 14 can be in two parts.

The device just described operates in the following manner.

In the case of the detonator shown in FIG. 1, the laser radiation conveyed by the optical fiber 3 transmits its energy to the pyrotechnic substance 2 and generates the combustion thereof.

The pressure developed by the combustion of the substance 2 propels the plate 7 at a speed greater than 500 m/s into the cavity 8 towards the bare surface 6*a* of the pyrotechnic substance 6 of the second stage.

The shock wave generated by the impact of the plate 7 on the surface 6*a* of the pyrotechnic substance detonates that substance.

The above features enable the manufacture of a shorter detonator which contains less pyrotechnic substance, which is less sensitive and more reproducible and which has a shorter response time than the solution referred to at the beginning of this description.

The total mass of the pyrotechnic substance is significantly reduced, in particular when the detonator according to the invention is applied to commanding the separation of two stages of a spacecraft, as it reduces the intensity of the pyrotechnic shocks transmitted to the craft.

Of course, the invention is not limited to the example that has just been described, to which many modifications can be made without departing from the scope of the invention.

There is claimed:

1. A shock-detonation translation type two-stage optical detonator wherein a first stage contains a first pyrotechnic substance and an optical fiber one end of which is connected to a source of laser radiation and an other end of which is adjacent said first pyrotechnic substance and is inserted into a connector and means between the other end of said optical fiber and said first pyrotechnic substance for transmitting laser radiation towards said first pyrotechnic substance and wherein a second stage contains a second pyrotechnic substance aligned with said first pyrotechnic substance of said first stage and separated therefrom by means for transmitting a shock wave generated by igniting said first pyrotechnic substance of said first stage and wherein said transmitting means separating said first pyrotechnic substance of said first stage from said second pyrotechnic substance of said second stage comprise a metal plate one face of which is in contact with said first pyrotechnic substance of said first stage and whose other face is adjacent a cavity which separates said metal plate from said second pyrotechnic substance of said second stage and whose edge portion bears against an end of a confinement member confining said second pyrotechnic substance of said second stage.

2. The optical detonator claimed in claim 1 wherein said cavity has a diameter which is greater than the diameter of said second pyrotechnic substance and an end face of said second pyrotechnic substance adjacent said cavity is coincident with a face constituting an end wall of said cavity.

3. The optical detonator claimed in claim 1 wherein said first pyrotechnic substance is confined in a confinement member which is connected axially and removably to said confinement member confining said second pyrotechnic substance.

4. The optical detonator claimed in claim 3 wherein said two confinement members are screwed together.

5. The optical detonator claimed in claim 1 wherein said plate is made of steel and is from 100 micrometers to 250 micrometers thick.

6. The optical detonator claimed in claim 1 wherein said laser energy transmitted to said first pyrotechnic substance of said first stage and the characteristics of said first pyrotechnic substance are such that said plate is propelled into said cavity at a speed of not less than 500 m/s after ignition of said first pyrotechnic substance.

7. The optical detonator claimed in claim 1 wherein said first pyrotechnic substance includes octogene having a charge density on the order of 1.65 g/cm$^3$ and a particle size on the order of 3 micrometers.

8. The optical detonator claimed in claim 7 wherein said octogene is mixed with approximately 1% ultrafine carbon black powder.

9. The optical detonator claimed in claim 1 wherein said second pyrotechnic substance of said second stage contains octogene or hexogene in granular form and has a density greater than 1.4 g/cm$^3$.

10. The optical detonator claimed in claim 1 wherein said means for transmitting laser radiation from said optical fiber to said first pyrotechnic substance comprise a ring with a glass ball in its aperture and in contact with the other end of said optical fiber connector and with a glass plate in contact with said first pyrotechnic substance.

11. The optical detonator claimed in claim 1 wherein said means for transmitting laser radiation between said optical fiber and said first pyrotechnic substance comprise a graded index glass rod housed in a member made from a material that is a poor conductor of heat and said glass rod is adapted to focus laser radiation from said optical fiber onto a face of said first pyrotechnic substance with which said glass rod is in contact.

* * * * *